United States Patent [19]

Buttriss

[11] 3,935,983

[45] Feb. 3, 1976

[54] ROOF NAILING MACHINE

[75] Inventor: Albert T. Buttriss, Fairview Park, Ohio

[73] Assignee: Eaton Corporation, Cleveland, Ohio

[22] Filed: Oct. 22, 1974

[21] Appl. No.: 516,921

[52] U.S. Cl. .....227/110; 227/120

[51] Int. Cl.² ..... B27F 7/02

[58] Field of Search ..... 227/7, 12, 13, 110, 111, 227/113, 120, 130, 132, 133, 145

[56] References Cited

UNITED STATES PATENTS

| | | | |
|---|---|---|---|
| 1,671,660 | 5/1928 | Vilneau et al. | 227/111 |
| 1,940,739 | 12/1933 | Arant | 227/145 |
| 3,734,377 | 5/1973 | Munn | 227/120 |

*Primary Examiner*—Granville Y. Custer, Jr.
*Attorney, Agent, or Firm*—Teagno & Toddy

[57] ABSTRACT

A fluid power driven roof nailing machine which receives a roofing nail and a sealing disc and, keeping them axially aligned, drives the nail through the disc into a surface to be nailed. The machine includes an arm swingably driven by a fluid motor, a sealing disc holder fixedly carried by the free end of the arm, and a nail driver positioned at the free end of the arm and mounted for sliding movement relative to the disc holder. A method of attaching roofing using such a machine is also disclosed.

14 Claims, 3 Drawing Figures

ROOF NAILING MACHINE

BACKGROUND OF THE INVENTION

1. Field of Invention

This invention relates generally to methods for attaching roofing and machines therefor and more particularly to portable fluid powered nailing machines.

2. Description of the Prior Art

While nailing machines and their use are known in the prior art (see, e.g., U.S. Pats. Nos. 1,671,660; 3,023,413; and 3,619,895), certain disadvantages in their use and construction have become apparent.

Among these is the lack of a provision for machine positioning of sealing discs used in roofing applications.

Other disadvantages of the prior art devices are that they require the use of complex driving mechanisms and demand a relatively high input power to the nail driver.

SUMMARY OF INVENTION

The disadvantages of the prior art devices are overcome in the present invention by the provision of a simple, portable, fluid power driven roof nailing machine.

It is an object of the present invention to provide a simple portable nailing machine in which the nailing mechanism is constructed in a manner effective to augment the nailing power transmitted to the nailing surface.

It is another object of the present invention to provide a portable nailing machine in which a sealing disc is positioned on the nailing surface in the same stroking operation with the driving of the nail.

According to an important feature of the present invention, the nail driver is connected to the stroking member by a lost motion connection which allows the driver to move inertially relative to the stroking motion in response to contact of the stroking member with the nailing surface; the inertial movement of the driving member is utilized to drive the nail into the nailing surface.

According to a further feature of the invention, the stroking member comprises an arm mounted for pivotal movement about one end and carrying the nail driver at its free end. As the free end of the arm is swung downwardly into contact with the nailing surface, the driver moves through its inertial stroke to drive the nail into the nailing surface.

According to another feature of the invention, the nailing machine includes provision for positioning a nail on the leading surface of the driver and further includes provision for disposing a sealing disc in a position forwardly of the nail and in the path of inertial movement of the driver so that the nailing stroke operates to deposit the sealing disc on the roofing surface and instantaneously thereafter drive the nail through the sealing disc and into the nailing surface.

According to still another feature of the present invention roofing is attached by manual insertion of a nail and disc into a nailing machine, energization of the machine to drive the nail through the disc, and operation of the machine to return to a position for receiving another nail and disc.

These and other objects and features will become obvious to those skilled in the art upon reading the following detailed description with reference to the accompanying drawings.

DESCRIPTION OF THE PREFERRED EMBODIMENT

Figures 1, 2, 3:
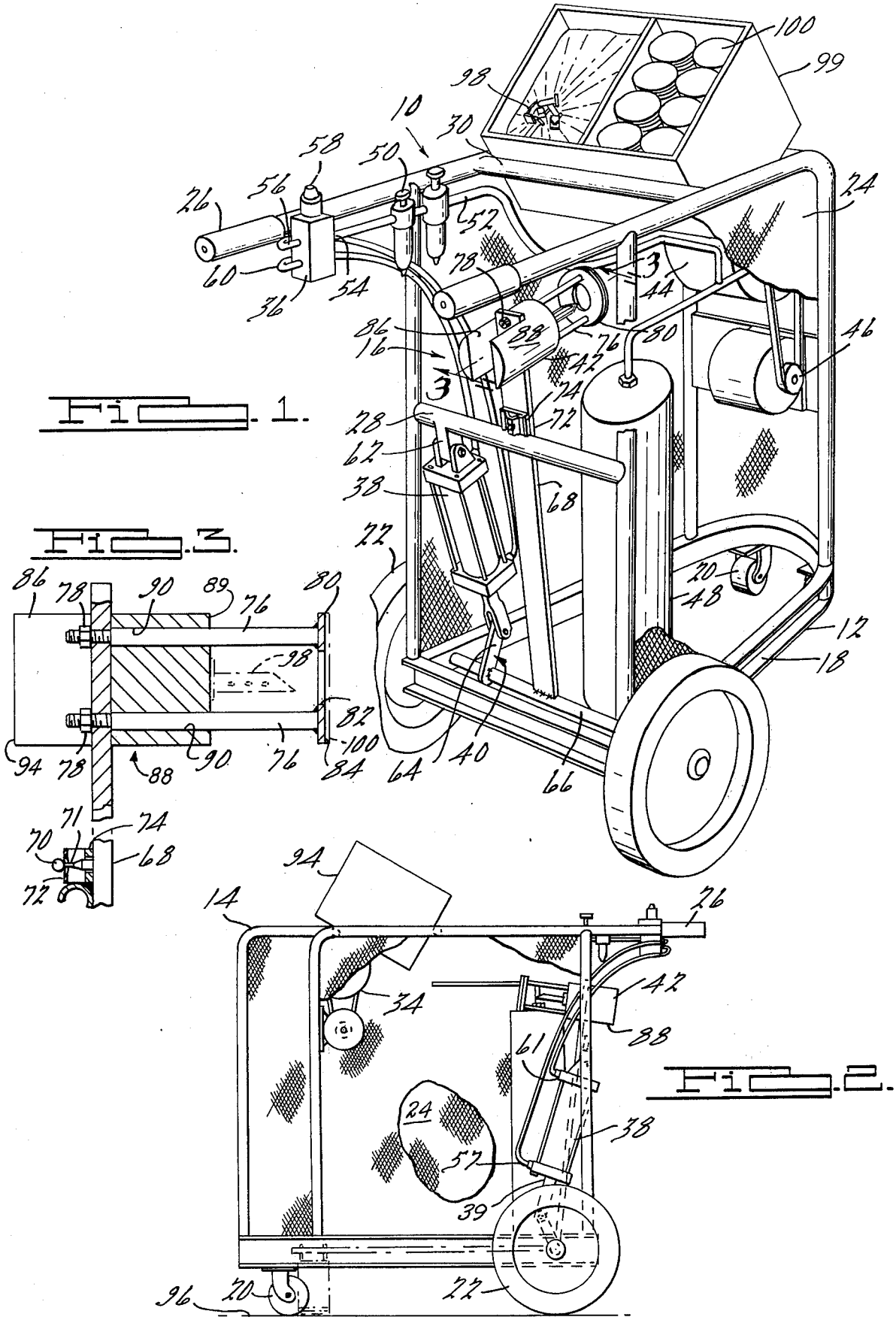
FIG. 1 is a perspective view of the nailing machine of the present invention.
FIG. 2 is a side elevational view of the nailing machine of the present invention illustrating the position in which a nail is driven.
FIG. 3 is a sectional view of the driver and disc holder of the present invention taken along line 3—3 of FIG. 1.

Referring now to the drawings the nailing machine 10 is illustrated as comprising a wheeled carriage 12 on which is carried a tubular frame 14 which supports and encloses a nail driving mechanism 16.

In the illustrated embodiment the carriage 12 includes a support frame 18 on which are mounted in a known manner relatively small steering wheels 20 and relatively large non-steering wheels 22.

The tubular frame 14 is fixed to the carriage support frame 18 by suitable fastening means (not shown). It is illustrated as a box-like structure formed from suitably bent and welded tubing, three sides of which are enclosed by screening 24, typically, but not necessarily, formed from relatively heavy gauge metal. Handles 26 extend rearwardly from the upper side members of the frame 14. (Front and rear and upper and lower orientations are as indicated in FIG. 2, rear being to the right of the figure). Cross members 28 and 30 extend between upright sides of the frame 14.

The nail driving mechanism 16 is illustrated as comprising a fluid power source 34, a directional control valve 36, a reversible fluid motor 38, pivotal actuation linkage 40, and a nail driving and disc holding assembly 42.

The fluid power source 34 is illustrated here as an air compressor 44 driven by an electric motor 46 and including a suitable pressure bearing tank or accumulator 48 and appropriate filters 50, but other fluid power sources including ones using different working fluids could likewise be chosen.

A discharge conduit 52 of the fluid power source 34 is in fluid communication with accumulator 48 and an inlet port 54 of the conventional designed directional control valve 36, which is biased to allow the free flow of fluid from the inlet port 54 to a first outlet port 56. A control, illustrated here as a manually actuated trigger button 58, is operative to prevent flow from the inlet port 54 to the first outlet port 56 and to allow the free flow of fluid from the inlet port 54 to a second outlet port 60.

The reversible fluid motor 38 is depicted here as a double acting piston-cylinder assembly of conventional design having first and second inlet ports 57 and 61 connected to control valve outlet ports 56 and 60 respectively. It is trunnion mounted at one end to a stationary arm 62 extending perpendicularly from cross member 28 and at the other end to the pivotal actuation linkage 40 through a crank 64 carried by a shaft 66 supported by the carriage 12.

Also extending perpendicularly from the shaft 66 is an arm 68 on which is disposed a locking pin 70 having an undercut 71 disposed thereon extending perpendicularly rearward to engage a spring clip 72 mounted on a vertically extending member 74 projecting from cross member 28 as shown in FIG. 3 when the nailing machine 10 is in a rest position.

The nail driving and disc holding assembly 42 is carried at the free end of the arm 68. In the embodiment shown it is illustrated as comprising a pair of rods 76 suitably fixed at one end to the arm 68 as by nuts 78 and at the other end to a disc-like holding member 80 through which is formed a central aperture 82 and the thickness of which is approximately equal to the height of the head of a roofing nail. The leading face 84 holding member 80 is suitably formed to retain a roofing nail sealing disc 100 as by being formed from permanently magnetic material or by carrying a replaceable adhesive such as a pressure sensitive adhesive that can be renewed or replaced as required.

A driver 88 is carried between the arm 68 and the holding member 80 as may best be seen in FIG. 3. The driver 88 is substantially cylindrical and has holes 90 formed through it which slidingly receive rods 76 to allow movement of the driver 88 between the arm 68 and the holding member 80. The driver 88 is further illustrated as having disposed therein a central slot 86 extending inwardly from the end 94 of the driver 88 proximate to arm 68. The driver 88 is adapted to hold a roofing nail 98 in a manner similar to that employed in the holding member 80, that is by being formed from a permanently magnetic material or by carrying a replaceable adhesive such as a pressure sensitive adhesive that can be renewed or replaced as required, on its leading face 89.

OPERATION OF THE INVENTION NAILING MACHINE

To attach roofing with the invention nailing machine the machine 10, which is in the rest position shown in solid lines in FIG. 2 is wheeled to a position to be nailed; and the compressor 44 is energized. Relatively fine adjustment of this position may be accomplished by use of a suitable visual guide or sighting device (not shown) which may be carried with the wheeled carriage 12 or frame 14. The operator, standing at the rear of the nailing machine 10, takes a disc 100 from a storage box 99, which may be carried resting on the cross bar 30 of frame 14, and places it on the disc holding member 80. He also selects a nail 98 and places it on the driver 88 pushing it against the arm 68. The trigger button 58 is then depressed and pressurized air is directed to the second inlet port 61 of fluid motor 38. This tends to extend the output rod 39 of the fluid motor 38 to turn the crank 64 and thus rotate the shaft 66 and pivot the arm 68. Movement is resisted, however, by the retention of locking pin 70 by spring clip 72. Differential pressure across the motor 38 builds up until the force exerted by spring clip 72 is overcome. The arm 68 then breaks away with relatively high acceleration since relatively little power is required to drive the rotating mass when free. The arm 68 continues to rotate until it is essentially horizontal at which point the disc holding member 80 places the disc 100 on the surface 96 to be nailed as it stops thereon; and the driver 88 carrying the nail 98 slides along the rods 76 causing the nail 98 to pierce the disc 100 and thereby attach roofing to the surface. Release of the trigger button 58 returns the directional control 36 to its biased position, reversing the pressurization of the motor 38 to return the arm to the rest position shown in FIG. 2.

What is claimed is:

1. A nailing machine comprising:

a wheeled carriage adapted for movement on a surface to be nailed, a frame mounted on said carriage, force transmitting means including a stroking member, means mounting said force transmitting means on said frame for movement of said stroking member through a nailing stroke, a nail driver, and means interconnecting said stroking member and said nail driver and including lost motion means operative to allow inertial movement of said nail driver from a rest position adjacent said stroking member to a working position remote from said stroking member in response to movement of said stroking member through its nailing stroke.

2. A nail driving machine as defined in claim 1 and further including:

means on said to releasably retain a nail on the leading surface of the driver, and means for releasably retaining a sealing disc in a position forward of the positioned nail and in the path of inertial movement of said driver so that the nailing stroke operates to deposit the sealing disc on the nailing surface and, instantaneously thereafter, drive the nail through the sealing disc and into the nailing surface.

3. A nail driving machine as defined in claim 1 and further including means on said to releasably retain a nail on the leading surface of the driver.

4. The nailing machine is defined in claim 1 wherein said stroking member comprises:

an arm pivotally mounted adjacent one end on said frame for movement between a rest position in which the free end of said arm is remote from said nailing surface, and a working position in which said free end is adjacent to said nailing surface, and said force transmitting means includes:

a source of motive power mounted on said frame, including means converting said power to rotary mechanical power, and operatively connected to pivot said arm, and said nail driver is carried adjacent the free end of said arm.

5. The nailing machine as defined in claim 4 wherein said source of motive power comprises:

a source of pressurized fluid;

a reversible fluid motor in fluid communication with said source of pressurized fluid and operatively connected to said arm.

6. A nailing machine as defined in claim 5 and further comprising:

means for stopping the movement of said arm at said rest position; and means for preventing movement of said arm away from said rest position until a predetermined differential pressure across said motor has been reached.

7. The nailing machine as defined in claim 4 wherein said lost motion means comprises:

a plurality of rods extending perpendicularly from the longitudinal side of said arm confronting said nailing surface when said arm is in the working position;

bores formed through said nail driver and registering with said rods to allow sliding movement of said nail driver on said rods; and means disposed on said rods for stopping movement of said nail driver at its remote working position.

8. A nail driving machine as defined in claim 7 wherein said stopping means comprises:

a sealing disc holding member fixedly connected to the free ends of said rods and having formed therethrough a centrally located aperture spaced radially inwardly from said through bores in said nail driver.

9. A nailing machine as defined in claim 8 wherein said disc holding member is generally ring shaped and includes a magnetic surface at the face thereof remote from said arm.

10. A nailing machine as defined in claim 9, wherein said driver comprises a hammer member including a magnetic surface at the end thereof remote from said arm.

11. A nailing machine as defined in claim 8 wherein said disc holding member is generally ring shaped and includes a replaceable adhesive surface at the face thereof remote from said arm.

12. A nailing machine as defined in claim 8 wherein said nail driver comprises a hammer member including a magnetic surface at the end thereof remote from said arm.

13. A nailing machine as defined in claim 8 wherein said driver comprises a hammer member including a replaceable adhesive surface at the end thereof remote from said arm.

14. A nailing machine comprising:

a wheeled carriage adapted for movement over a surface to be nailed, a frame mounted on said carriage, a reciprocally rotatively actuated arm pivotally mounted on said frame, and nail driving means carried on the free end of said arm and reciprocally rotatable therewith.

* * * * *

UNITED STATES PATENT AND TRADEMARK OFFICE

CERTIFICATE OF CORRECTION

PATENT NO. : 3,935,983

DATED : February 3, 1976

INVENTOR(S) : Albert T. Buttriss

It is certified that error appears in the above-identified patent and that said Letters Patent are hereby corrected as shown below:

Col. 4, line 20: after "said" insert—driver—.

Col. 4, line 30: after "said" insert—driver—.

Col. 4, line 32: "is" should read—as—.

Signed and Sealed this

*fourth* Day of *May 1976*

[SEAL]

*Attest:*

RUTH C. MASON
*Attesting Officer*

C. MARSHALL DANN
*Commissioner of Patents and Trademarks*